US010804591B1

(12) United States Patent
Logan et al.

(10) Patent No.: US 10,804,591 B1
(45) Date of Patent: Oct. 13, 2020

(54) SIDE MOUNTING OF MEMS MICROPHONES ON TAPERED HORN ANTENNA

(71) Applicant: Jabil Inc., St. Petersburg, FL (US)

(72) Inventors: David Donald Logan, St. Petersburg, FL (US); Katelyn Christensen, St. Petersburg, FL (US)

(73) Assignee: Jabil Inc., St. Petersburg, FL (US)

( * ) Notice: Subject to any disclaimer, the term of this patent is extended or adjusted under 35 U.S.C. 154(b) by 0 days.

(21) Appl. No.: 16/380,327

(22) Filed: Apr. 10, 2019

(51) Int. Cl.

| | |
|---|---|
| ***H01Q 13/00*** | (2006.01) |
| ***H01Q 1/22*** | (2006.01) |
| ***H01Q 13/02*** | (2006.01) |
| ***H04R 1/08*** | (2006.01) |
| ***H04R 1/02*** | (2006.01) |
| ***H01P 5/12*** | (2006.01) |
| *H01P 5/00* | (2006.01) |
| *H01Q 13/04* | (2006.01) |

(52) U.S. Cl.
CPC ..... *H01Q 1/22* (2013.01); *H01P 5/12* (2013.01); *H01Q 13/02* (2013.01); *H04R 1/028* (2013.01); *H04R 1/08* (2013.01); *H01P 5/00* (2013.01); *H01Q 13/04* (2013.01); *H04R 2201/003* (2013.01)

(58) Field of Classification Search
CPC .. H01P 5/00; H01P 5/12; H01Q 13/02; H01Q 13/04
See application file for complete search history.

(56) References Cited

U.S. PATENT DOCUMENTS 2,362,561 A * 11/1944 Katzin ..... H01Q 13/0258 343/756
2,398,096 A * 4/1946 Katzin ..... H01Q 13/02 343/756

(Continued)

FOREIGN PATENT DOCUMENTS

KR 20150059152 A 5/2015

OTHER PUBLICATIONS

International search report issued in corresponding international application No. PCT/US2020/027357 dated Jul. 30, 2020.

*Primary Examiner* — Thuy Vinh Tran
(74) *Attorney, Agent, or Firm* — Young Basile Hanlon & MacFarlane, P.C.

(57) ABSTRACT

Disclosed herein are implementations of devices and methods for side mounting of microelectromechanical systems (MEMS) transducers on tapered horn antennae. A hole is made in a sidewall of a tapered horn antenna, where the hole is substantially cylindrical, tapered and the like. In an implementation, an internal port opening of a MEMS microphone is aligned with the hole and attached to the sidewall of the tapered horn antenna. In an implementation, the hole is tapered with a diameter at one end, either the same or slightly larger than the diameter of the port opening of the MEMS microphone and a larger diameter at another end of the hole. In an implementation, a tube is used to connect the internal port opening of the MEMS antenna to the hole in the tapered horn antenna. In an implementation, the tapered horn antenna may have multiple holes, each having its respective MEMS transducer.

20 Claims, 11 Drawing Sheets

(56) References Cited

U.S. PATENT DOCUMENTS

| | | | | |
|---|---|---|---|---|
| 6,501,431 | B1 * | 12/2002 | Irion, II | H01Q 13/08 343/767 |
| 7,057,570 | B2 * | 6/2006 | Irion, II | H01P 5/10 343/725 |
| 8,902,114 | B1 * | 12/2014 | West | H01Q 25/00 343/722 |
| 2005/0030241 | A1 * | 2/2005 | Brown | H01Q 13/02 343/786 |
| 2015/0109068 | A1 | 4/2015 | Kawata | |
| 2017/0214120 | A1 | 7/2017 | Lee et al. | |
| 2017/0324135 | A1 | 11/2017 | Blech et al. | |
| 2019/0069108 | A1 | 2/2019 | Lee et al. | |

* cited by examiner

300

1200

SIDE MOUNTING OF MEMS MICROPHONES ON TAPERED HORN ANTENNA

TECHNICAL FIELD

This disclosure relates to electronics and mounting of microelectromechanical systems (MEMS) sensors in electronic devices.

BACKGROUND

Microelectromechanical systems (MEMS) sensors such as microphones have been used in portable devices, mobile phones, head sets, medical devices, laptops and other like applications and devices. Due to their size, MEMS sensors are particularly useful for low profile or thin device applications. However, there are some practical considerations that need to be accounted for. The frequency response of a MEMS microphone system, for example, under application conditions requires tuning of the dimensions of the tube opening and cavity volume located in front of the MEMS microphone's port opening. The air volume associated with the physical dimensions of the tube opening and cavity in front of the MEMS microphone's port opening determines the inherent Helmholtz resonance of the system. In the case where the MEMS microphone is held directly against a vibrating surface such as skin to measure heart sounds, the straight cylindrical tube and the air cavity do not exist. As a result, the output signal from the MEMS microphone is severely attenuated and not very useful.

A horn shaped air cavity placed in front of the MEMS microphone's port opening via a short length of open tube provides the required air volume and as a result, the MEMS microphone can sense enough signal amplitude in the sound pressure to provide reasonable signal-to-noise (SNR). Traditionally, the horn's throat would be considered the optimized location for mounting a sensing device such as a MEMS microphone. However, this may add to the overall height or length profile of the end device.

SUMMARY

Disclosed herein are implementations of devices and methods for side mounting of microelectromechanical systems (MEMS) transducers on tapered horn antennae. A perforation or hole may be made in a sidewall of a tapered horn antenna. In an implementation, the hole may be substantially cylindrical, tapered and the like. In an implementation, the MEMS transducer is a MEMS microphone. In an implementation, a port opening of a MEMS microphone may be aligned with the hole and attached to the sidewall of the tapered horn antenna. In an implementation, the hole may be tapered with a diameter at one end substantially similar to a diameter of the port opening of the MEMS microphone and a larger diameter at another end of the hole. In an implementation, an intermediary structure may be used to connect the MEMS transducer to the hole in the tapered horn antennae. In an implementation, a tube may be used to connect the port opening of the MEMS antenna to the hole in the tapered horn antenna. In an implementation, the tube may be cylindrical, tapered, and the like. In an implementation, the tapered horn antenna may have multiple holes, each hole having an attached MEMS transducer.

BRIEF DESCRIPTION OF THE DRAWINGS

The disclosure is best understood from the following detailed description when read in conjunction with the accompanying drawings and are incorporated into and thus constitute a part of this specification. It is emphasized that, according to common practice, the various features of the drawings are not to-scale. On the contrary, the dimensions of the various features are arbitrarily expanded or reduced for clarity.

DETAILED DESCRIPTION

Figure 1B:
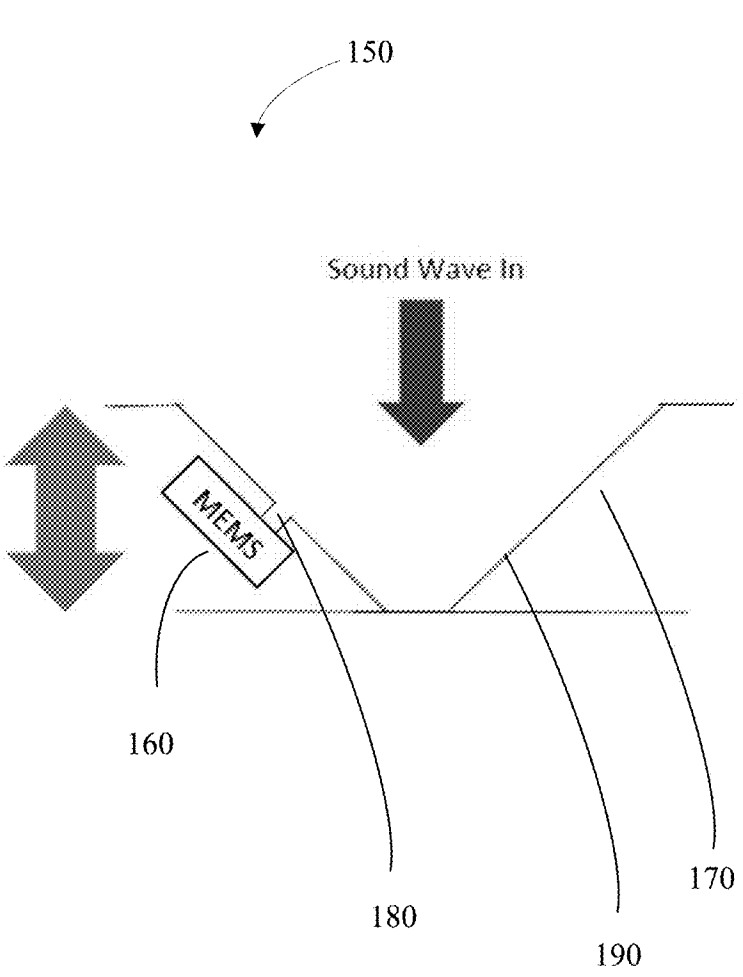
FIGS. 1A-B are block diagrams of a MEMS microphone attached at a throat of the tapered horn antenna and of an example microelectromechanical systems (MEMS) microphone attached via a hole in a sidewall of a tapered horn antenna in accordance with implementations.

The figures and descriptions provided herein may be simplified to illustrate aspects of the described embodiments that are relevant for a clear understanding of the herein disclosed processes, machines, manufactures, and/or compositions of matter, while eliminating for the purpose of clarity other aspects that may be found in typical similar devices, systems, compositions and methods. Those of ordinary skill may thus recognize that other elements and/or steps may be desirable or necessary to implement the devices, systems, compositions and methods described herein. However, because such elements and steps are well known in the art, and because they do not facilitate a better understanding of the disclosed embodiments, a discussion of such elements and steps may not be provided herein. However, the present disclosure is deemed to inherently include all such elements, variations, and modifications to the described aspects that would be known to those of ordinary skill in the pertinent art in light of the discussion herein.

Embodiments are provided throughout so that this disclosure is sufficiently thorough and fully conveys the scope of the disclosed embodiments to those who are skilled in the art. Numerous specific details are set forth, such as examples of specific aspects, devices, and methods, to provide a thorough understanding of embodiments of the present disclosure. Nevertheless, it will be apparent to those skilled in the art that certain specific disclosed details need not be employed, and that embodiments may be embodied in different forms. As such, the exemplary embodiments set forth should not be construed to limit the scope of the disclosure.

The terminology used herein is for the purpose of describing particular embodiments only and is not intended to be limiting. For example, as used herein, the singular forms "a", "an" and "the" may be intended to include the plural forms as well, unless the context clearly indicates otherwise. The terms "comprises," "comprising," "including," and "having," are inclusive and therefore specify the presence of stated features, steps, operations, elements, and/or components, but do not preclude the presence or addition of one or more other features, steps, operations, elements, components, and/or groups thereof.

The steps, processes, and operations described herein are thus not to be construed as necessarily requiring their respective performance in the particular order discussed or illustrated, unless specifically identified as a preferred or required order of performance. It is also to be understood that additional or alternative steps may be employed, in place of or in conjunction with the disclosed aspects.

Yet further, although the terms first, second, third, etc. may be used herein to describe various elements, steps or aspects, these elements, steps or aspects should not be limited by these terms. These terms may be only used to distinguish one element or aspect from another. Thus, terms such as "first," "second," and other numerical terms when used herein do not imply a sequence or order unless clearly indicated by the context. Thus, a first element, step, component, region, layer or section discussed below could be termed a second element, step, component, region, layer or section without departing from the teachings of the disclosure.

The non-limiting embodiments described herein are with respect to devices and methods for making the devices, where the devices are microelectromechanical systems (MEMS) transducers which are attached to a sidewall of a tapered horn antenna via a hole. The device and method for making the device may be modified for a variety of applications and uses while remaining within the spirit and scope of the claims. The embodiments and variations described herein, and/or shown in the drawings, are presented by way of example only and are not limiting as to the scope and spirit. The descriptions herein may be applicable to all embodiments of the device and the methods for making the devices.

Disclosed herein are implementations of devices and methods for side mounting of microelectromechanical systems (MEMS) transducers on tapered horn antennae. Although the description herein uses MEMS microphones for purposes of illustration, other MEMS transducers may be used without departing from the scope of the specification and the claims. Although the description herein is with respect to MEMS transducers, polyvinylidene difluoride (PVDF) sensors, piezoelectric sensors and the like may be used without departing from the scope of the specification and the claims.

Figure 1A:
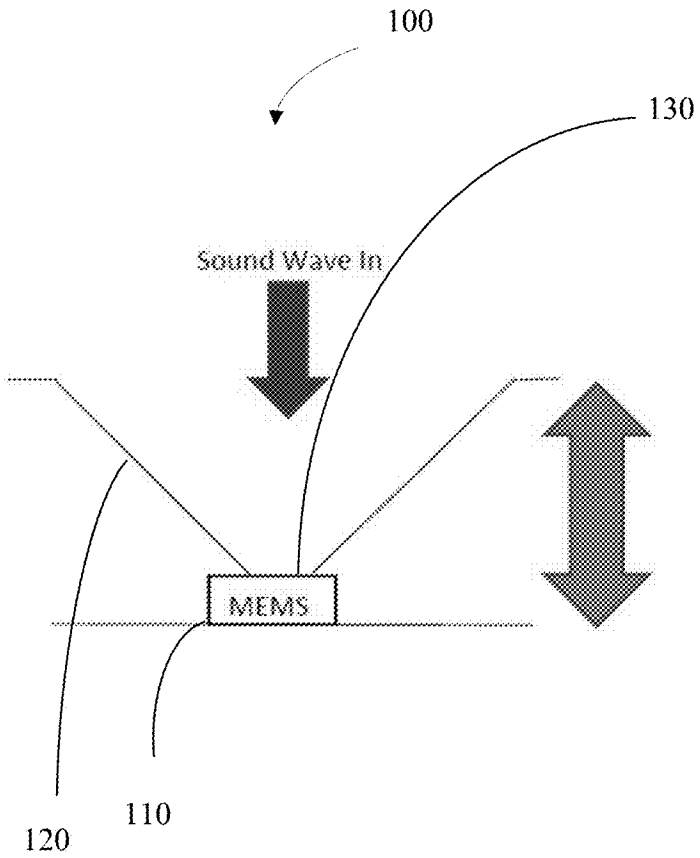

FIG. 1A is a block diagram of an example device 100 which includes a MEMS microphone 110 attached to a tapered horn antenna 120. In particular, the MEMS microphone 110 is attached to a throat 130 of the tapered horn antenna 120. As shown, this increases the footprint of the device 100 in terms of length or height by the length or height of the MEMS microphone 110.

FIG. 1B is a block diagram of a device 150 which includes a MEMS microphone 160 attached to a tapered horn antenna 170. In particular, the MEMS microphone 160 is attached via a hole 180 in a sidewall 190 of the tapered horn antenna 170 in accordance with certain implementations. As described herein below, the sidewall mounted MEMS microphone 160 does not degrade the overall sound pressure performance at low frequencies. For example, there is no or minimal sound pressure performance degradation up to 5 kHz. In fact, at frequencies between 5 kHz to 8 kHz there is an increase in the MEMS microphone 160 sensitivity.

Figure 2:
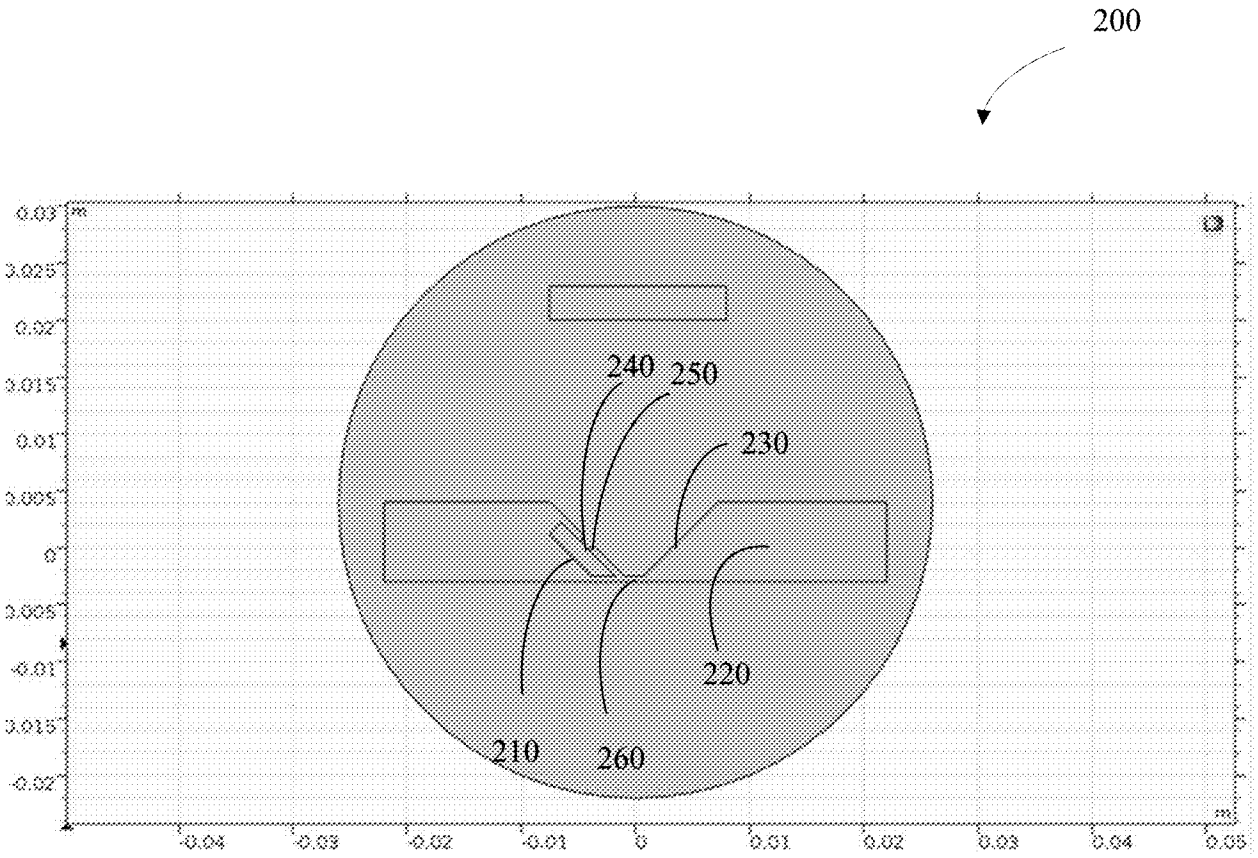
FIG. 2 is an example simulation model for an example MEMS microphone attached via a hole in a sidewall of a tapered horn antenna in accordance with implementations.

FIG. 2 is an example simulation model of an example device 200 having a MEMS microphone 210 attached via a hole 240 in a sidewall 230 of a tapered horn antenna 220 in accordance with certain implementations. The internal port opening 250 of the MEMS microphone 210 is at a defined distance away from an external wall (i.e. sidewall 230) of the tapered horn antenna 220 via the hole 240, which is a smaller horn shaped opening. A chamber of the MEMS microphone 210 is sealed at the bottom and a throat area 260 of the tapered horn antenna 220 is sealed.

Figure 3:
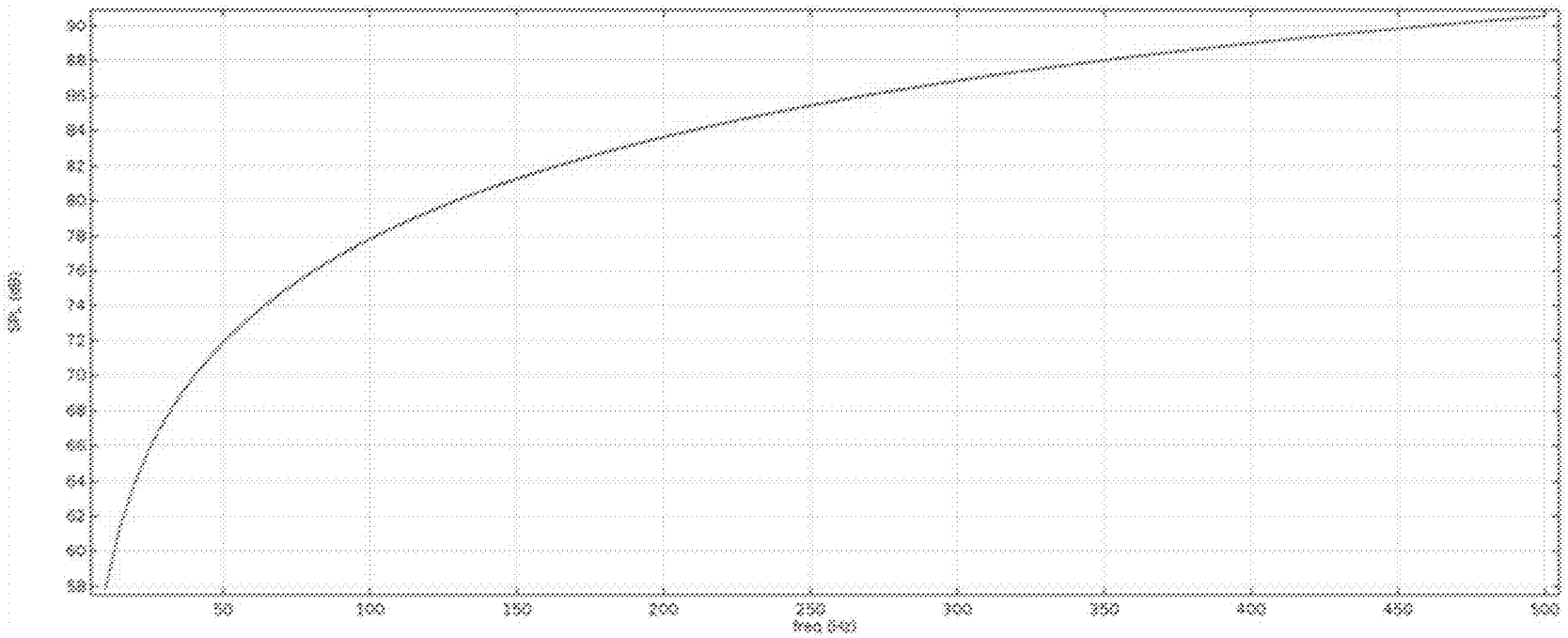
FIG. 3 is a simulated frequency response graph comparing sidewall mounted MEMS microphone in accordance with implementations to a throat mounted MEMS microphone.

FIG. 3 is a simulated frequency response graph 300 comparing the sidewall mounted MEMS microphone 210 of FIG. 2 to the throat mounted MEMS microphone 260. At low frequencies, the simulated frequency response curves of the MEMS microphone 210 mounted on the sidewall 230 of the tapered horn antenna 220 versus a MEMS mounted at the throat 260 of the tapered horn antenna 220 overlap each other. Therefore, there is no loss in sound pressure level (SPL) with the MEMS microphone 210 mounted on the sidewall 230 of the tapered horn antenna 220 at low frequencies.

Besides having no signal losses at low frequencies and improved sensitivity at higher frequencies, mounting the MEMS microphone 160 on the sidewall 190 of the tapered horn antenna 170 reduces the overall length of the device 150 by an amount equivalent to the total thickness of the MEMS microphone 160. This savings in real estate is a valuable commodity in thin film sensing devices such as, but not limited to, electrocardiogram (ECG) patches and the like. This mounting configuration may allow MEMS microphones to be used in low profile applications where real estate is significantly limited. The reduction in real estate used may be approximately 33% when compared to mounting configurations utilizing a throat area of the tapered horn antenna.

Figure 4:
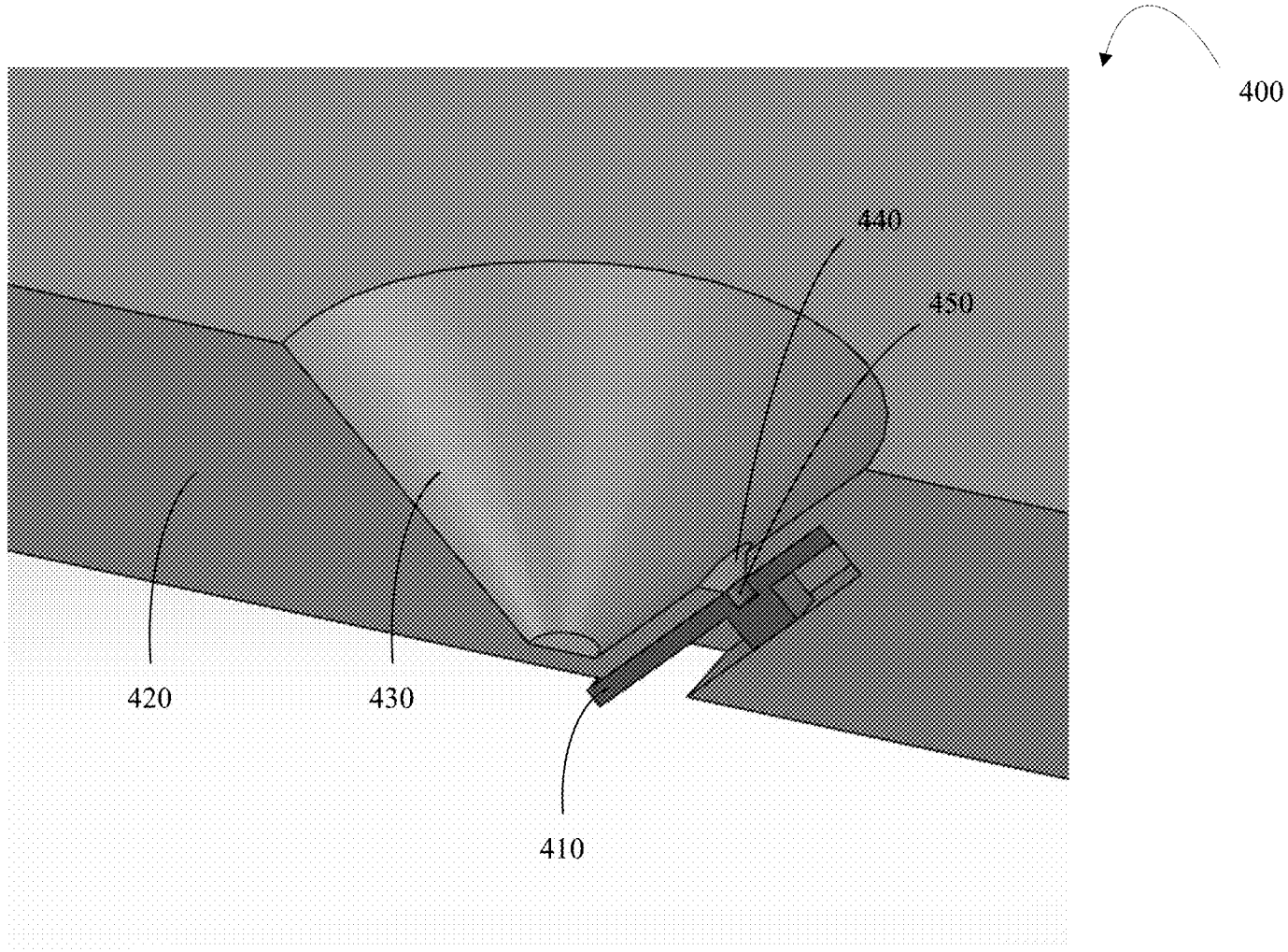
FIG. 4 is a 3D perspective view of a block diagram of an example MEMS microphone attached via a tapered hole in a sidewall of a tapered horn antenna in accordance with implementations.

FIG. 4 is a 3D perspective view of a block diagram of an example device 400 which includes a MEMS microphone 410 attached to a tapered horn antenna 420. The tapered horn antenna 420 includes a sidewall 430. The sidewall 430 has a horn shaped hole 440. The MEMS microphone 410 has an internal port opening 450. One diameter of the horn shaped hole 440 is the same or slightly larger than the diameter of the internal port opening 450. The MEMS microphone 410 is attached to the tapered horn antenna 420 by aligning the horn shaped hole 440 with the internal port opening 450. The aligned MEMS microphone 410 and the tapered horn antenna 420 are then attached by pressing the MEMS microphone 410 up against the sidewall 430 with a soft compression gasket seal located at the interface (not shown) and then securing the MEMS microphone 410 into place by using epoxy or other known techniques. The soft compression gasket seal is illustrative and other devices and mechanisms that provide an air seal and reduce the mechanical coupling of vibrations that may occur between the tapered horn antenna 420 and MEMS microphone 410 may be used as known to those skilled in the art.

Figure 5:
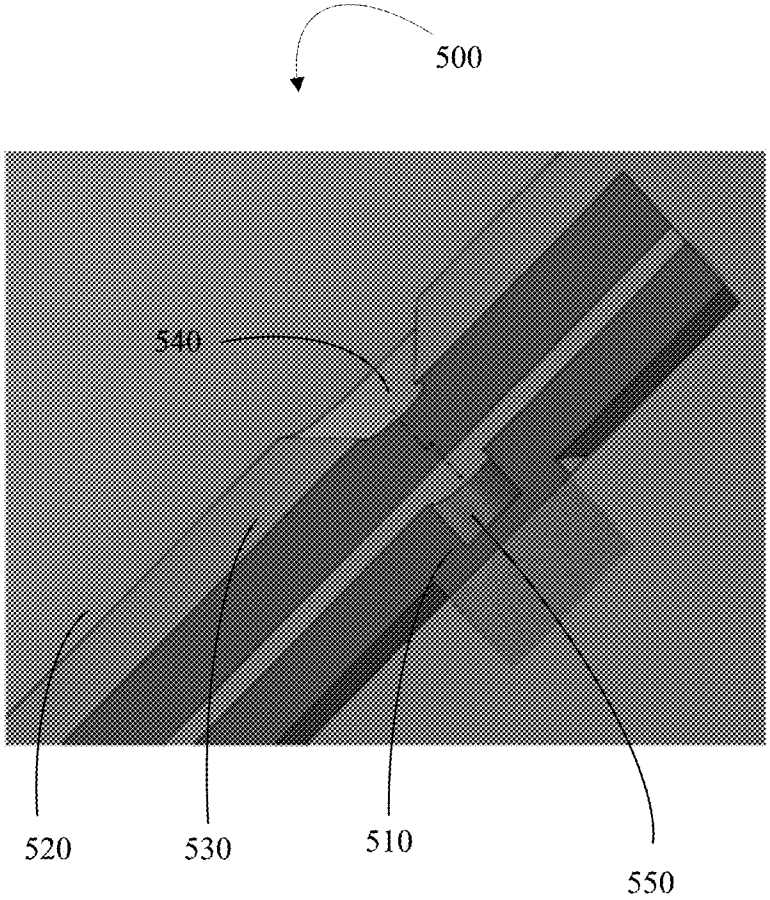
FIG. 5 is a zoomed view of a block diagram of an example MEMS microphone prior to attachment via a tapered hole in a sidewall of a tapered horn antenna in accordance with implementations.

FIG. 5 is a zoomed cross-sectional view of a block diagram of an example device 500 which includes a MEMS microphone 510 prior to attachment to a tapered horn antenna 520. The tapered horn antenna 520 includes a sidewall 530. The sidewall 530 has a horn shaped hole 540. The MEMS microphone 510 has an internal port opening 550. One diameter of the horn shaped hole 540 is the same or slightly larger than the diameter of the internal port opening 550. Attachment of the MEMS microphone 510 to the tapered horn antenna 520 is done by aligning the horn shaped hole 540 with the internal port opening 550 and then attaching the MEMS microphone 510 to the tapered horn antenna 520 are then attached by pressing the MEMS microphone 510 up against the sidewall 530 with a soft compression gasket seal located at the interface (not shown) and then secure the MEMS microphone 510 into place by using epoxy or other known techniques. The soft compression gasket seal is illustrative and other devices and mechanisms that provide an air seal and reduce the mechanical coupling of vibrations that may occur between the tapered horn antenna 520 and MEMS microphone 510 may be used as known to those skilled in the art.

Figure 6:
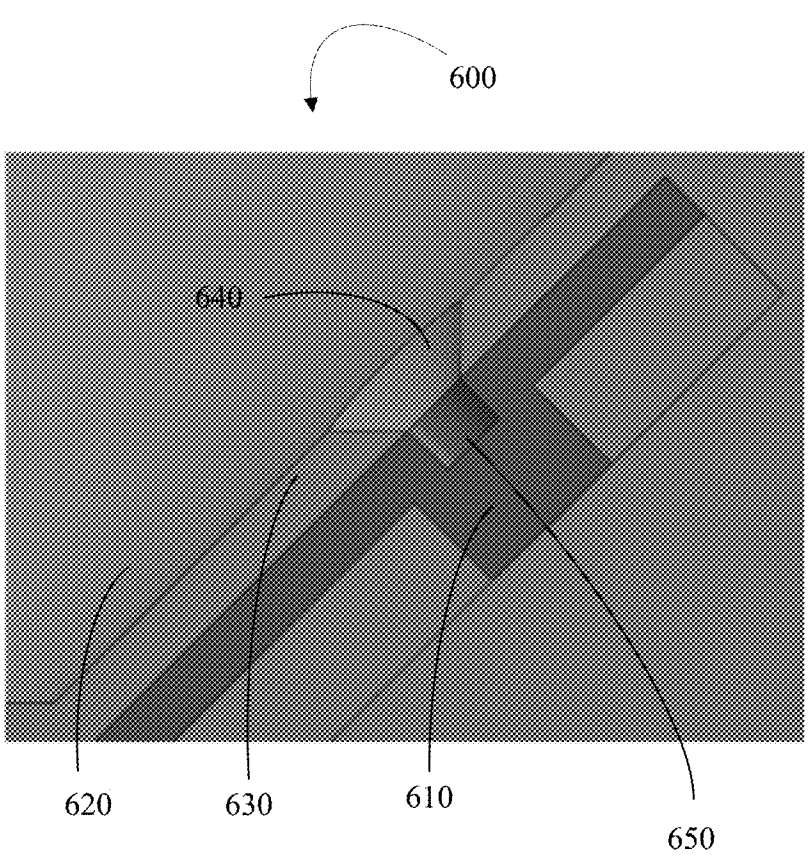
FIG. 6 is a zoomed view of a block diagram of an example MEMS microphone attached via a tapered hole in a sidewall of a tapered horn antenna in accordance with implementations.

FIG. 6 is a zoomed view of a block diagram of an example device 600 which includes an example MEMS microphone 610 attached to a tapered horn antenna 620. The tapered horn antenna 620 includes a sidewall 630. The sidewall 630 has a horn shaped hole 640. The MEMS microphone 610 has an internal port opening 650. One diameter of the horn shaped hole 640 is the same or slightly larger than the diameter of the internal port opening 650. The MEMS microphone 610 is attached to the tapered horn antenna 620 by aligning the horn shaped hole 640 with the internal port opening 650. The aligned MEMS microphone 610 and the tapered horn antenna 620 are then attached by pressing the MEMS microphone 610 up against the sidewall 630 with a soft compression gasket seal located at the interface (not shown) and then secure the MEMS microphone 610 into place by using epoxy or other known techniques. The soft compression gasket seal is illustrative and other devices and mechanisms that provide an air seal and reduce the mechanical coupling of vibrations that may occur between the tapered horn antenna 620 and MEMS microphone 610 may be used as known to those skilled in the art.

Figure 7:
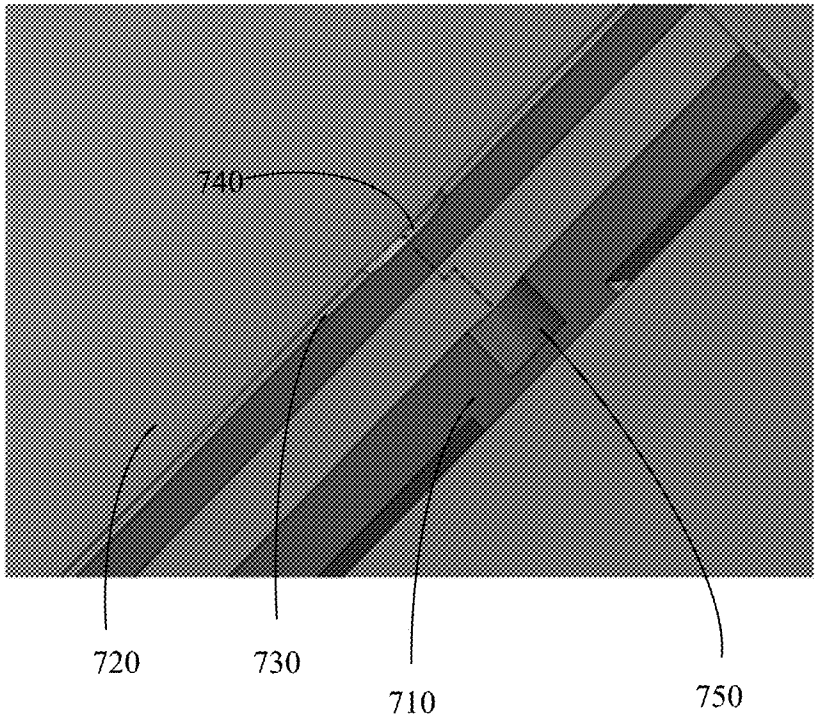
FIG. 7 is a zoomed view of a block diagram of an example MEMS microphone prior to attachment via a hole in a sidewall of a tapered horn antenna in accordance with implementations.

FIG. 7 is a zoomed view of a block diagram of an example device 700 which includes a MEMS microphone 710 prior to attachment to a tapered horn antenna 720. The tapered horn antenna 720 includes a sidewall 730. The sidewall 730 has a hole 740 which allows for a flush mounting of the MEMS microphone 710. The MEMS microphone 710 has an internal port opening 750. A diameter of the hole 740 is the same or slightly larger than the diameter of the internal port opening 750. Attachment of the MEMS microphone 710 to the tapered horn antenna 720 is done by aligning the hole 740 with the internal port opening 750 and then attaching the MEMS microphone 710 to the tapered horn antenna 720 are then attached by pressing the MEMS microphone 710 up against the sidewall 730 with a soft compression gasket seal located at the interface (not shown) and then secure the MEMS microphone 710 into place by using epoxy or other known techniques. The soft compression gasket seal is illustrative and other devices and mechanisms that provide an air seal and reduce the mechanical coupling of vibrations that may occur between the tapered horn antenna 720 and MEMS microphone 710 may be used as known to those skilled in the art.

Figure 8:
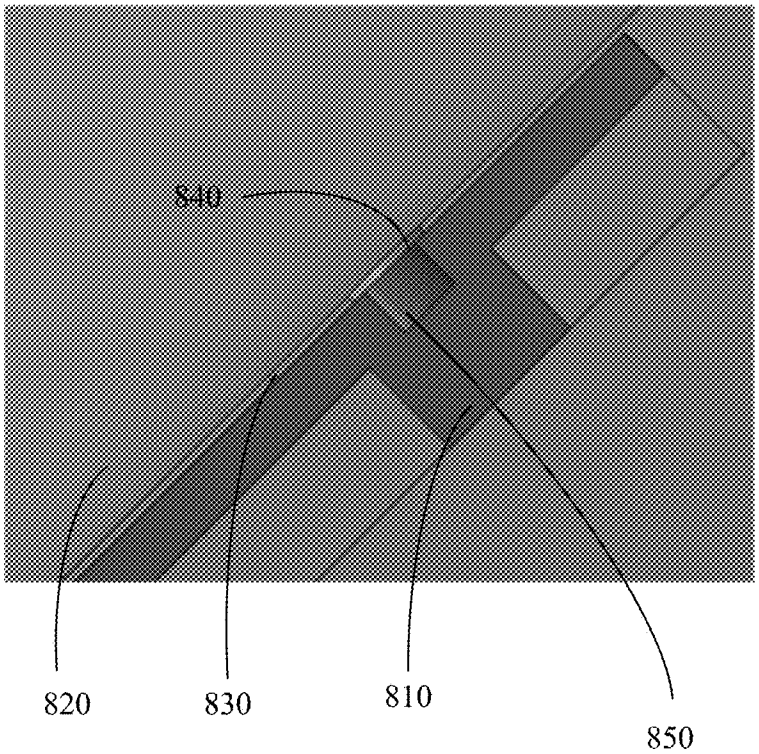
FIG. 8 is a zoomed view of a block diagram of an example MEMS microphone attached via a hole in a sidewall of a tapered horn antenna in accordance with implementations.

FIG. 8 is a zoomed view of a block diagram of an example device 800 which includes a MEMS microphone 810 attached to a tapered horn antenna 820. The tapered horn antenna 820 includes a sidewall 830. The sidewall 830 has a hole 840 which allows for a flush mounting of the MEMS microphone 810. The MEMS microphone 810 has an internal port opening 850. A diameter of the hole 840 is the same or substantially same as the diameter of the internal port opening 850. The MEMS microphone 810 is attached to the tapered horn antenna 820 by aligning the hole 840 with the internal port opening 850. The aligned MEMS microphone 810 and the tapered horn antenna 820 are then attached by pressing the MEMS microphone 810 up against the sidewall 830 with a soft compression gasket seal located at the interface (not shown) and then secure the MEMS microphone 810 into place by using epoxy or other known techniques. The soft compression gasket seal is illustrative and other devices and mechanisms that provide an air seal and reduce the mechanical coupling of vibrations that may occur between the tapered horn antenna 820 and MEMS microphone 810 may be used as known to those skilled in the art.

Figures 9A, 9B, 9C:
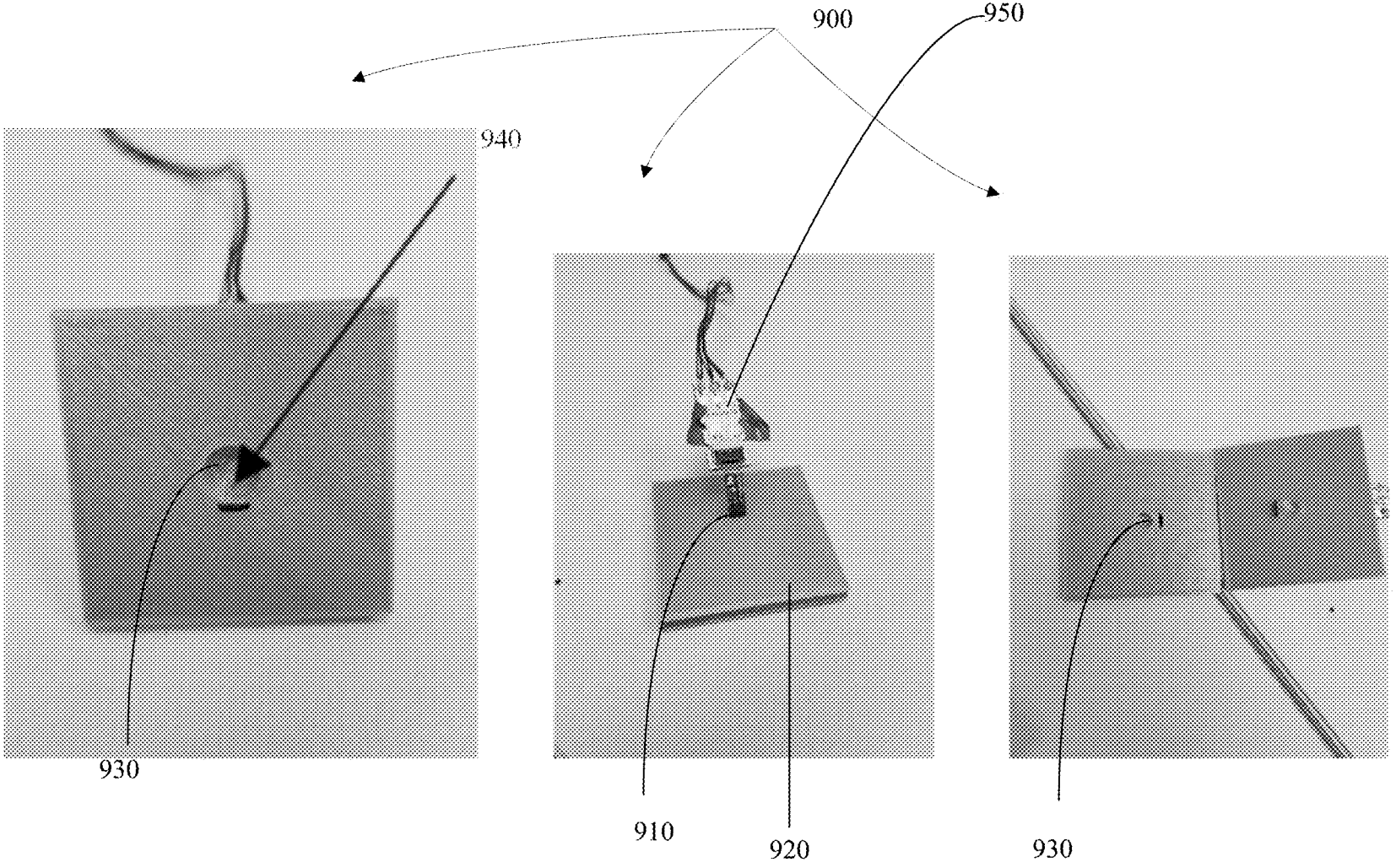
FIGS. 9A-C are photographs of an example MEMS microphone attached via a hole in a sidewall of a tapered horn antenna in accordance with implementations.
Figure 10:
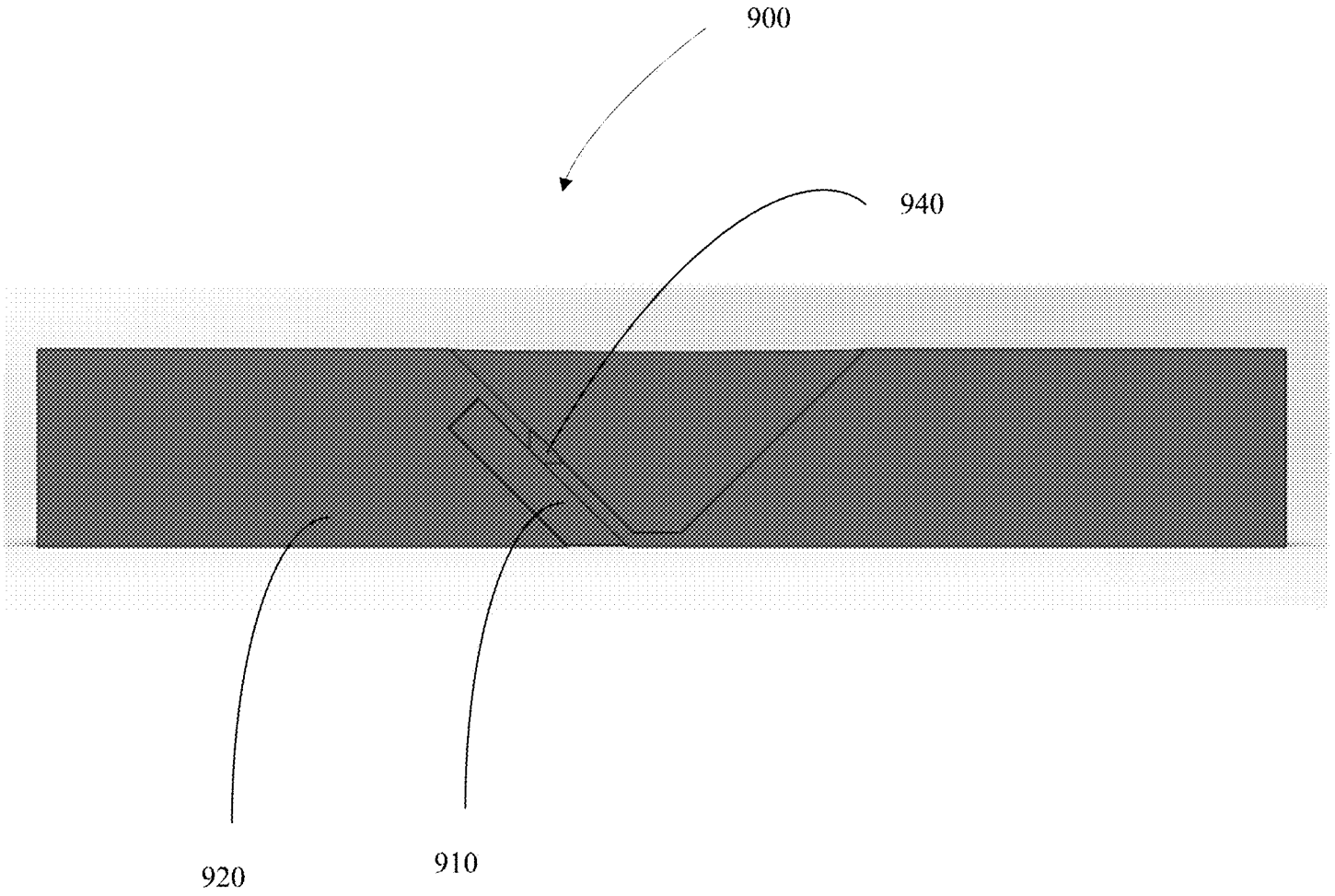
FIG. 10 is a cross-sectional view of an example MEMS microphone attached via a hole in a sidewall of a tapered horn antenna in accordance with implementations.
Figures 11A, 11B, 11C:
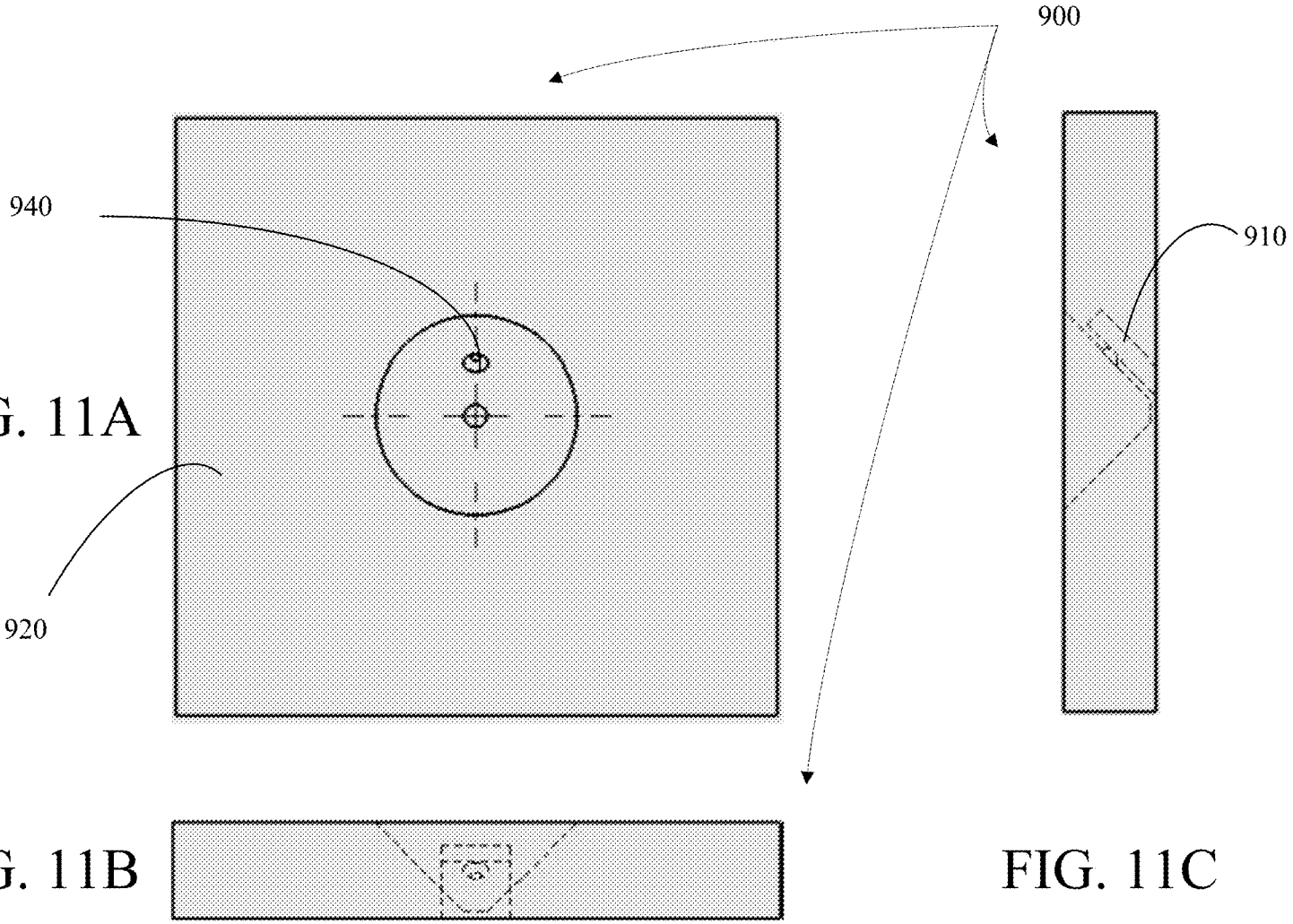
FIGS. 11A-C are top, right side cross-sectional, and front cross-sectional views of an example MEMS microphone attached via a hole in a sidewall of a tapered horn antenna in accordance with implementations.

FIGS. 9A-C are photographs of an example device 900 including a MEMS microphone 910 attached to a tapered horn antenna 920. The tapered horn antenna 920 includes a sidewall 930. The sidewall 930 has a hole 940. The MEMS microphone 910 has an internal port opening (not shown). A diameter of the hole 940 is the same or slightly larger than the diameter of the port opening. The MEMS microphone 910 is attached to the tapered horn antenna 920 by aligning the hole 940 with the port opening. The aligned MEMS microphone 910 and the tapered horn antenna 920 are then attached by pressing the MEMS microphone 910 up against the sidewall 930 with a soft compression gasket seal located at the interface (not shown) and then secure the MEMS microphone 910 into place by using epoxy or other known techniques. The soft compression gasket seal is illustrative and other devices and mechanisms that provide an air seal and reduce the mechanical coupling of vibrations that may occur between the tapered horn antenna 920 and MEMS microphone 910 may be used as known to those skilled in the art. FIG. 9B shows an electrical connector 950 being attached to the MEMS microphone 910 for processing. FIG. 10 is a cross-sectional view of the device 900 which shows the MEMS microphone 910 attached to the tapered horn antenna 920 via the hole 940. FIGS. 11A-C are top, right side cross-sectional, and front cross-sectional views of the device 900 which shows the MEMS microphone 910 attached to the tapered horn antenna 920 via the hole 940.

Figure 12:
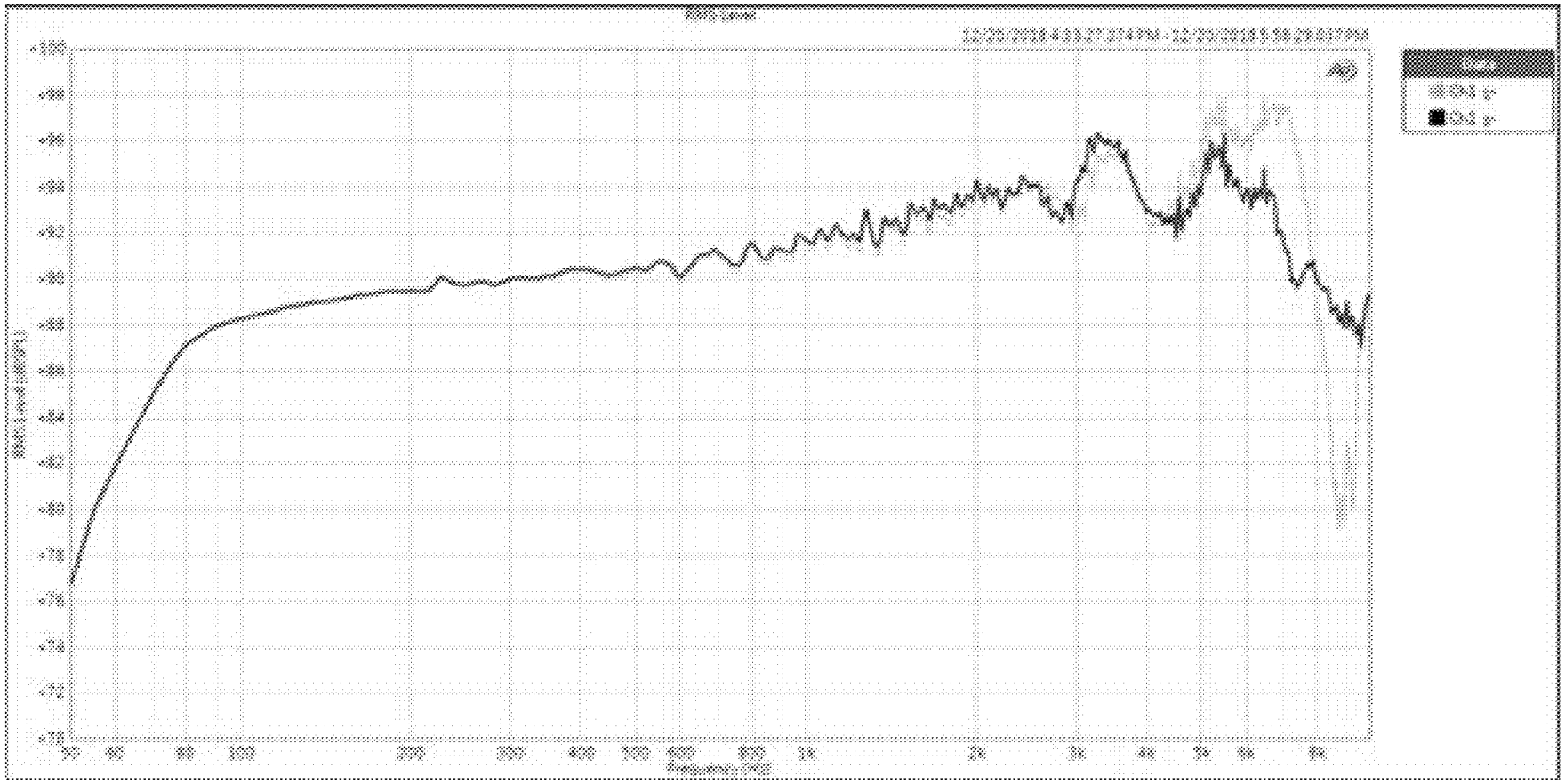
FIG. 12 is a measured sound pressure level graph comparing a sidewall mounted MEMS microphone in accordance with implementations (light grey) to a throat mounted MEMS microphone (black).

FIG. 12 is a sound pressure level graph 1200 of a sidewall mounted MEMS microphone in accordance with implementations (light grey) to a throat mounted MEMS microphone (black). The measurement results confirm the simulations shown in FIG. 3. The SPL curves of the throat mounted MEMS microphone and the sidewall mounted MEMS microphone match closely up to approximately 5 kHz. In the region between 5 kHz and 8 kHZ, the sidewall mounted MEMS microphone shows improved sensitivity to sound pressure versus the throat mounted MEMS microphone.

Figure 13:
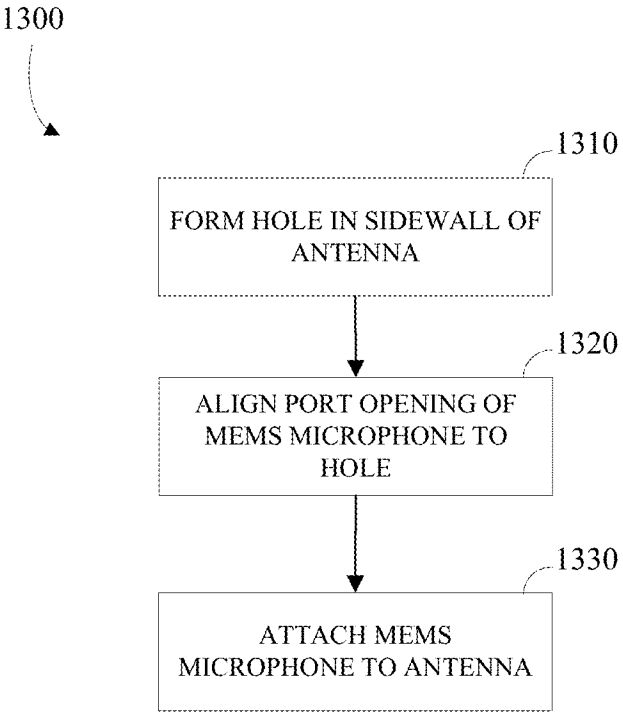
FIG. 13 is a flowchart of an example process mounting a MEMS microphone via a hole in a sidewall of a tapered horn antenna in accordance with implementations.

FIG. 13 is a flowchart of an example process mounting a MEMS microphone via a hole in a sidewall of a tapered horn antenna in accordance with certain implementations. The method 1300 includes: forming 1310 a hole in a sidewall of a tapered horn antenna; aligning 1320 a port opening of the MEMS microphone with the hole; and attaching 1330 the MEMS microphone to the tapered horn antenna.

The method 1300 includes forming 1310 a hole in a sidewall of a tapered horn antenna. In an implementation, the hole is cylindrical having a diameter that is the same or slightly larger than the same as a diameter of an internal port opening of a MEMS microphone. In an implementation, the hole is tapered horn hole having a diameter at an attachment end that is the same or slightly larger than a diameter of an internal port opening of a MEMS microphone. The remaining end of the tapered horn hole having a diameter greater than the diameter at the attachment end. In an implementation, a connecting tube may be used to connect the MEMS microphone to the tapered horn antenna. In an implementation, the connecting tube may have a cylindrical shape. In an implementation, the connecting tube may have a tapered horn shape. At least one end of the connecting tube may be the same or slightly larger than a diameter of an internal port opening of a MEMS microphone. In an implementation, multiple holes may be formed into the sidewall of the horn to support a multiple MEMS device implementation to improve overall system signal to noise ratio (SNR).

The method 1300 includes aligning 1320 the internal port opening of the MEMS microphone with the hole. In an implementation, the internal port opening of the MEMS microphone is substantially aligned with the hole. In an implementation with multiple holes in the sidewall, each port opening of the MEMS microphone may be aligned to one of the multiple holes.

The method 1300 includes attaching 1330 the MEMS microphone to the tapered horn antenna. The attachment of the MEMS microphone to the tapered horn antenna may be accomplished using a number of techniques including pressing the MEMS microphone up against the horn sidewall with a soft compression gasket seal located at the interface and then secure the MEMS microphone into place by using epoxy or other known techniques. The soft compression gasket seal is illustrative and other devices and mechanisms that provide an air seal and reduce the mechanical coupling of vibrations that may occur between the tapered horn antenna and MEMS microphone may be used as known to those skilled in the art. In an implementation with multiple holes in the sidewall, each MEMS microphone may be attached to one of the multiple holes.

The construction and arrangement of the methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials and components, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

Although the figures may show a specific order of method steps, the order of the steps may differ from what is depicted. Also, two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule-based logic and other logic to accomplish the various connection steps, processing steps, comparison steps, and decision steps.

While the disclosure has been described in connection with certain embodiments, it is to be understood that the disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A method for attaching a microelectromechanical systems (MEMS) microphone to an antenna, the method comprising:

forming a hole in a sidewall of an antenna;

aligning an internal port opening of a MEMS microphone with the hole; and attaching the MEMS microphone to the antenna.

2. The method of claim 1, wherein a diameter of the hole is same or slightly larger than a diameter of the internal port opening.

3. The method of claim 1, wherein the hole has a cylindrical shape.

4. The method of claim 1, wherein the antenna is a tapered horn antenna.

5. The method of claim 4, wherein the hole has a tapered horn shape.

6. The method of claim 5, wherein an end closest to the internal port opening has a same or slightly larger diameter than the internal port opening.

7. The method of claim 6, wherein a remaining end has a diameter that is at least slightly larger than the diameter of the end closest to the internal port opening.

8. The method of claim 1, further comprising:

placing a connecting tube between the hole and the internal port opening.

9. The method of claim 8, wherein the connecting tube has a cylindrical shape.

10. The method of claim 8, wherein the connecting tube has a tapered horn shape.

11. The method of claim 10, wherein the connecting tube end closest to the internal port opening has a same or slightly larger diameter than the internal port opening.

12. The method of claim 10, wherein a connecting tube remaining end has a diameter that is at least slightly larger than the diameter of the connecting tube end.

13. The method of claim 1, wherein:

the forming further comprising forming multiple holes in the sidewall of the antenna;

the aligning further comprising aligning each internal port opening of each MEMS microphone with a hole of the multiple holes; and the attaching further comprising attaching each MEMS microphone to the antenna.

14. A device comprising:

an antenna having a throat and a sidewall, wherein the sidewall has at least one hole; and a microelectromechanical systems (MEMS) microphone having an internal port opening, wherein the MEMS microphone is attached to the antenna at a juncture of the hole and the internal port opening.

15. The device of claim 14, wherein a diameter of the hole is same or slightly larger than a diameter of the internal port opening.

16. The device of claim 15, wherein the hole has one of a cylindrical shape and a tapered horn antenna shape.

17. The device of claim 16, wherein the antenna is a tapered horn antenna.

18. The device of claim 17, further comprising:

a connecting tube, wherein the connecting tube is between the hole and the internal port opening.

19. The device of claim 14, wherein the at least one hole is multiple holes and further comprising multiple MEMS microphones, and wherein each internal port opening of each MEMS microphone is attached to a respective hole of the multiple holes.

20. A device comprising:

a tapered horn antenna having a throat and at least one sidewall, wherein at least one of the at least one sidewall has a hole; and at least one microelectromechanical systems (MEMS) microphone having an internal port opening, wherein the at least one MEMS microphone is attached to the tapered horn antenna at a juncture of the hole and the internal port opening.

* * * * *